US010208961B2

(12) United States Patent
Sanfrey et al.

(10) Patent No.: US 10,208,961 B2
(45) Date of Patent: Feb. 19, 2019

(54) ONE-PIECE SHEET-METAL STRUCTURE FORMED WITH CLENCH LOCKED CORNERS

(71) Applicant: Pennant Moldings, Inc., Sabrina, OH (US)

(72) Inventors: Keith Sanfrey, Sabina, OH (US); John S. Meyer, Greensburg, IN (US)

(73) Assignee: Pennant Moldings, Inc., Sabina, OH (US)

( * ) Notice: Subject to any disclaimer, the term of this patent is extended or adjusted under 35 U.S.C. 154(b) by 595 days.

(21) Appl. No.: 14/800,844

(22) Filed: Jul. 16, 2015

(65) Prior Publication Data

US 2017/0016625 A1 Jan. 19, 2017

(51) Int. Cl.
*F24C 15/02* (2006.01)
*B21D 39/02* (2006.01)

(52) U.S. Cl.
CPC ..... *F24C 15/02* (2013.01); *B21D 39/02* (2013.01)

(58) Field of Classification Search
CPC ..... F24C 15/02; B21D 39/02
USPC ..... 126/190, 198
See application file for complete search history.

(56) References Cited

U.S. PATENT DOCUMENTS 329,559 A * 11/1885 Hohenstein ..... B65D 5/22 229/179
370,483 A * 9/1887 Jordan ..... B65D 5/248 229/172
1,557,066 A * 10/1925 Krantz ..... H02G 3/081 220/3.94
1,755,694 A * 4/1930 Keppler ..... B65D 5/248 229/172
2,143,308 A * 1/1939 Flach ..... B65D 5/22 229/172
2,536,530 A * 1/1951 Bergstein ..... B65D 5/248 229/172
2,765,973 A * 10/1956 Goldstein ..... B65D 5/28 229/125
2,804,255 A * 8/1957 Bergh ..... B65D 7/34 220/62
3,091,381 A * 5/1963 Conescu ..... B65D 5/248 229/125.19
3,169,518 A * 2/1965 Scott ..... A47B 77/08 108/64
3,246,829 A * 4/1966 Sexton ..... B65D 5/247 229/122

(Continued)

*Primary Examiner* — Joshua K Ihezie
(74) *Attorney, Agent, or Firm* — Porter, Wright, Morris & Arthur, LLP

(57) ABSTRACT

A one-piece sheet-metal structure includes a first wall, a second wall perpendicularly extending from the first wall, and a third wall perpendicularly extending from the first wall. The second wall is perpendicular to the first wall and the third wall. An end edge of the second wall is adjacent an end edge of the third wall to form a corner. The corner is provided with a clench lock so that the corner is weld-free. The clench lock includes bottom and top tabs. The bottom tab perpendicularly extends from the end edge of the second wall at a bottom tab bend and engages an inner side of the third wall. The top tab perpendicularly extends from an outer edge of the third wall at a top tab bend and bends around the bottom tab and engages an inner side of the bottom tab to clench the bottom tab at the corner.

20 Claims, 7 Drawing Sheets

(56) References Cited

U.S. PATENT DOCUMENTS 3,457,427 A * 7/1969 Tarneja ..... B64G 1/443 136/244
3,606,078 A * 9/1971 Phillips, Jr. ..... B65D 5/247 220/62
3,756,499 A * 9/1973 Giebel ..... B65D 5/22 229/117.17
3,883,067 A * 5/1975 McGlynn ..... B65D 5/0045 229/177
4,055,293 A * 10/1977 Stramaglia ..... B65D 5/248 229/175
4,469,273 A * 9/1984 Smith ..... B65D 5/68 229/117.03
4,628,185 A * 12/1986 Norwood ..... A47J 37/0623 219/386
5,211,330 A * 5/1993 Frey ..... B65D 5/248 229/162.1
5,682,017 A * 10/1997 Marrotte ..... H02G 3/086 174/53
7,065,928 B1 * 6/2006 Lane ..... E04D 13/0315 52/200
8,438,893 B2 * 5/2013 Durney ..... B21D 5/00 72/324
2003/0037586 A1 * 2/2003 Durney ..... B21D 28/10 72/379.2
2006/0277965 A1 * 12/2006 Durney ..... B21D 51/52 72/379.2
2011/0008573 A1 * 1/2011 Durney ..... B21D 5/00 428/131
2012/0061277 A1 * 3/2012 Lohse ..... B65D 11/1833 206/504
2012/0125804 A1 * 5/2012 Kaltman ..... B65D 5/2047 206/525
2014/0352151 A1 * 12/2014 Bruin-Slot ..... F24C 15/2071 29/897.3
2015/0047198 A1 * 2/2015 Bruin-Slot ..... F24C 15/2071 29/897.3
2017/0059177 A1 * 3/2017 Yancey ..... F24C 15/028

* cited by examiner

ONE-PIECE SHEET-METAL STRUCTURE FORMED WITH CLENCH LOCKED CORNERS

CROSS-REFERENCE TO RELATED APPLICATIONS

Not Applicable

STATEMENT REGARDING FEDERALLY SPONSORED RESEARCH

Not Applicable

PARTIES TO A JOINT RESEARCH AGREEMENT

Not Applicable

REFERENCE TO APPENDIX

Not Applicable

FIELD OF THE INVENTION

The field of the present invention generally relates to structures formed by bending a sheet of metal and, more particularly, to such sheet-metal structures having corners such as, for example, kitchen appliance door structures.

BACKGROUND OF THE INVENTION

Kitchen appliances such as, for example, ovens, dishwashers, and refrigerators typically having a door that can be opened and closed to access the interior of the kitchen appliance. With the current popularity of stainless steel kitchen appliances, the doors often are formed from sheets of stainless steel. For example, such oven doors often include a one-piece structure formed by bending a single sheet of stainless steel. This one-piece structure includes a plurality of corners where three walls perpendicular to each other meet to form the corners. Because the corners are formed by bending a single sheet of stainless steel, the corners have an open or unconnected seam between the two side walls at each corner. Thus, once the one-piece structure is removed from the dies that form the structure, additional processing operations must be performed to complete the corners.

Once the one-piece structure is removed from the dies, protective vinyl covering the stainless steel must be manually scored and removed at the corners. With protective vinyl covering removed, the unconnected seams at the corners are welded together. Once welded, the weld and surrounding area must be metal finished such as manually grinding the surface with a grinding wheel so that the welded area has a finish closely matching the existing brush or finish on the remainder of the stainless-steel structure. It should be noted that this is a skilled and labor intensive process. The structure is then inspected. If the part passes inspection it is bagged or otherwise packaged for shipment.

While the above-described process provides suitable one-piece sheet metal formed structures having corners, there is a never ending desire to decrease the cost of procuring products including consumer goods such as, for example, kitchen appliances. Accordingly, there is a need for improved one-piece sheet-metal formed structures having corners and methods for forming the same.

SUMMARY OF THE INVENTION

Disclosed are one-piece structures and methods for forming the same which address one or more issues of the related art. Disclosed is a one-piece sheet-metal structure comprising, in combination, a first wall, a second wall perpendicularly extending from the first wall at a second wall bend, and a third wall perpendicularly extending from the first wall at a third wall bend. The second wall is perpendicular to the third wall. A first end edge of the second wall is adjacent to a first end edge of the third wall to form a first corner. A first bottom tab perpendicularly extends from the first end edge of the second wall at a first bottom tab bend and engages an inner side of the third wall. A first top tab perpendicularly extends from an outer edge of the third wall at a first top tab bend and bent around the first bottom tab and engages an inner side of the first bottom tab to clench the first bottom tab at the first corner.

Also disclosed is a method for forming a one-piece structure comprising, in combination, the steps of, providing sheet metal to form a first wall, bending a second wall perpendicularly extending from the first wall at a second wall bend, and bending a third wall perpendicularly extending from the first wall at a third wall bend. The second wall is perpendicular to the third wall. A first end edge of the second wall is adjacent to a first end edge of the third wall to form a first corner. The method further comprises the steps of bending a first bottom tab perpendicularly extending from the first end edge of the second wall at a first bottom tab bend to engage an inner side of the third wall, and bending a first top tab perpendicularly extending from an outer edge of the third wall at a first top tab bend and around the first bottom tab to engage an inner side of the first bottom tab to clench the first bottom tab at the first corner.

Also disclosed is a one-piece oven frame formed by a method comprising, in combination, the steps of, providing a sheet of stainless steel to form a first wall, bending a second wall perpendicularly extending from the first wall at a second wall bend, and bending a third wall perpendicularly extending from the first wall at a third wall bend. The second wall is perpendicular to the third wall. A first end edge of the second wall is adjacent to a first end edge of the third wall to form a first corner. the method also includes the steps of bending a first bottom tab perpendicularly extending from the first end edge of the second wall at a first bottom tab bend to engage an inner side of the third wall, and bending a first top tab perpendicularly extending from an outer edge of the third wall at a first top tab bend and around the first bottom tab to engage an inner side of the first bottom tab to clench the first bottom tab at the first corner.

From the foregoing disclosure and the following more detailed description of various preferred embodiments it will be apparent to those skilled in the art that the present invention provides a significant advance in the technology and art of methods for forming one-piece sheet-metal structures having corners. Particularly significant in this regard is the potential the invention affords for forming one-piece sheet-metal structures having corners with major cost reduction to reduced labor requirements and fewer damaged parts because the protective nylon covering is not removed from any of the critical surfaces after removal of the structure from the forming dies and before shipment. Additional features and advantages of various preferred embodiments will be better understood in view of the detailed description provided below.

BRIEF DESCRIPTION OF THE DRAWINGS

These and further features of the present invention will be apparent with reference to the following description and drawings.

Figure 1:
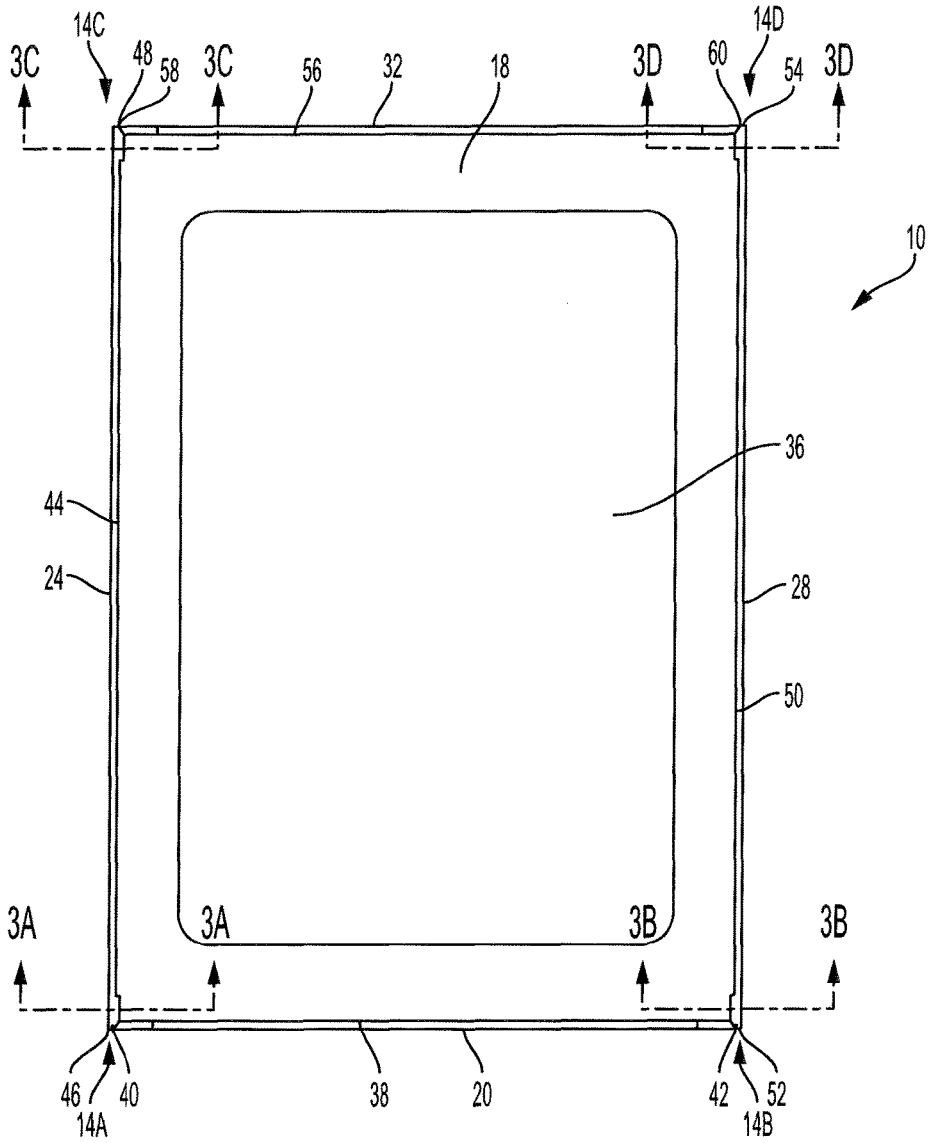
FIG. 1 is a rear view of a one-piece oven door structure formed of sheet metal according to the present invention.
Figure 2:
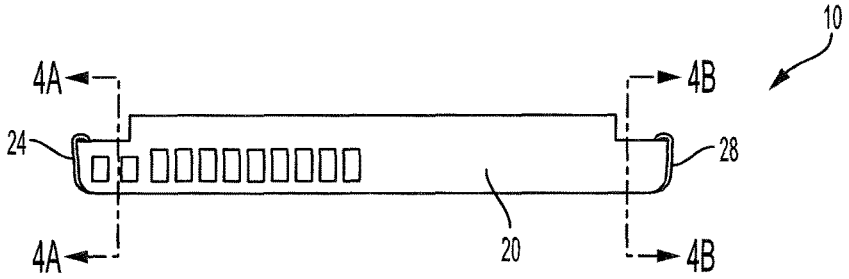
FIG. 2 is a bottom plan view of the one-piece oven door structure of FIG. 1.
Figure 3A:
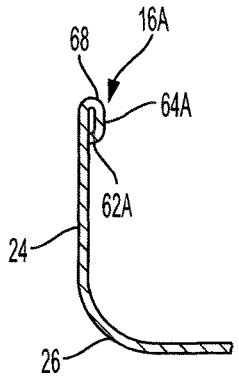
FIG. 3A is an enlarged cross sectional view taken along line 3A-3A of FIG. 1.
Figure 3B:
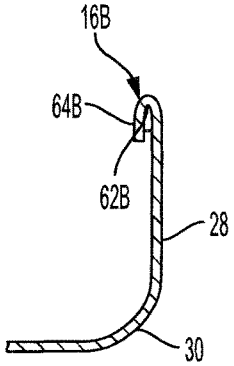
FIG. 3B is an enlarged cross sectional view taken along line 3B-3B of FIG. 1.
Figure 3C:
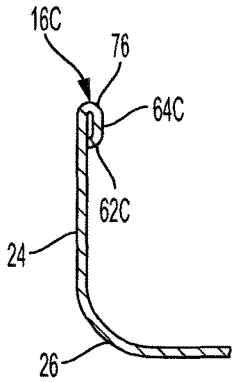
FIG. 3C is an enlarged cross sectional view taken along line 3C-3C of FIG. 1.
Figure 3D:
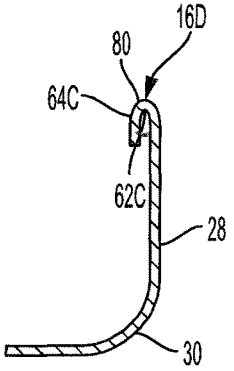
FIG. 3D is an enlarged cross sectional view taken along line 3D-3D of FIG. 1.
Figure 4A:
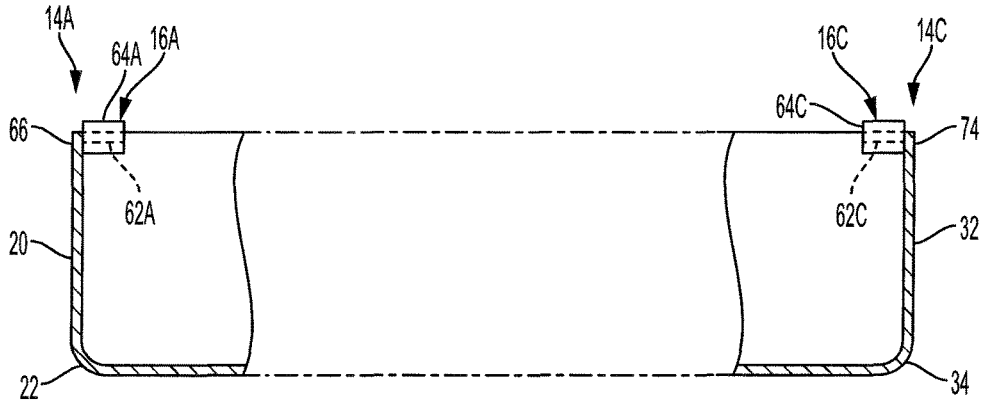
FIG. 4A is an enlarged, fragmented cross sectional view taken along line 4A-4A of FIG. 1.
Figure 4B:
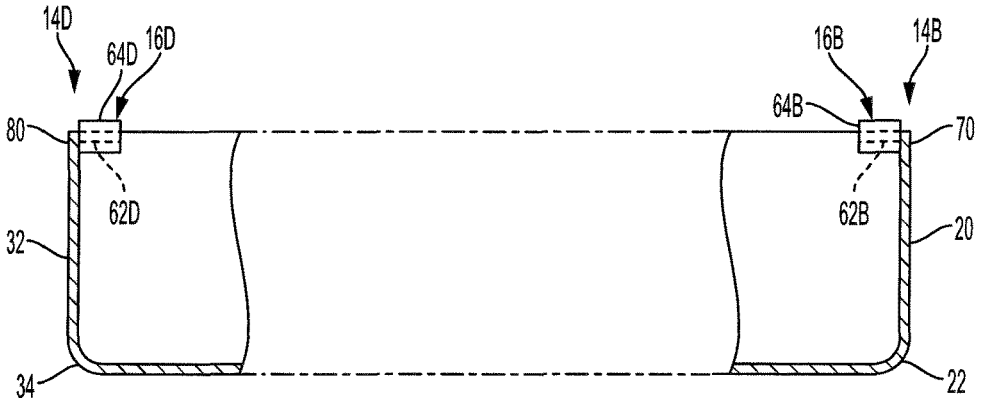
FIG. 4B is an enlarged, fragmented cross sectional view taken along line 4B-4B of FIG. 1.
Figure 5:
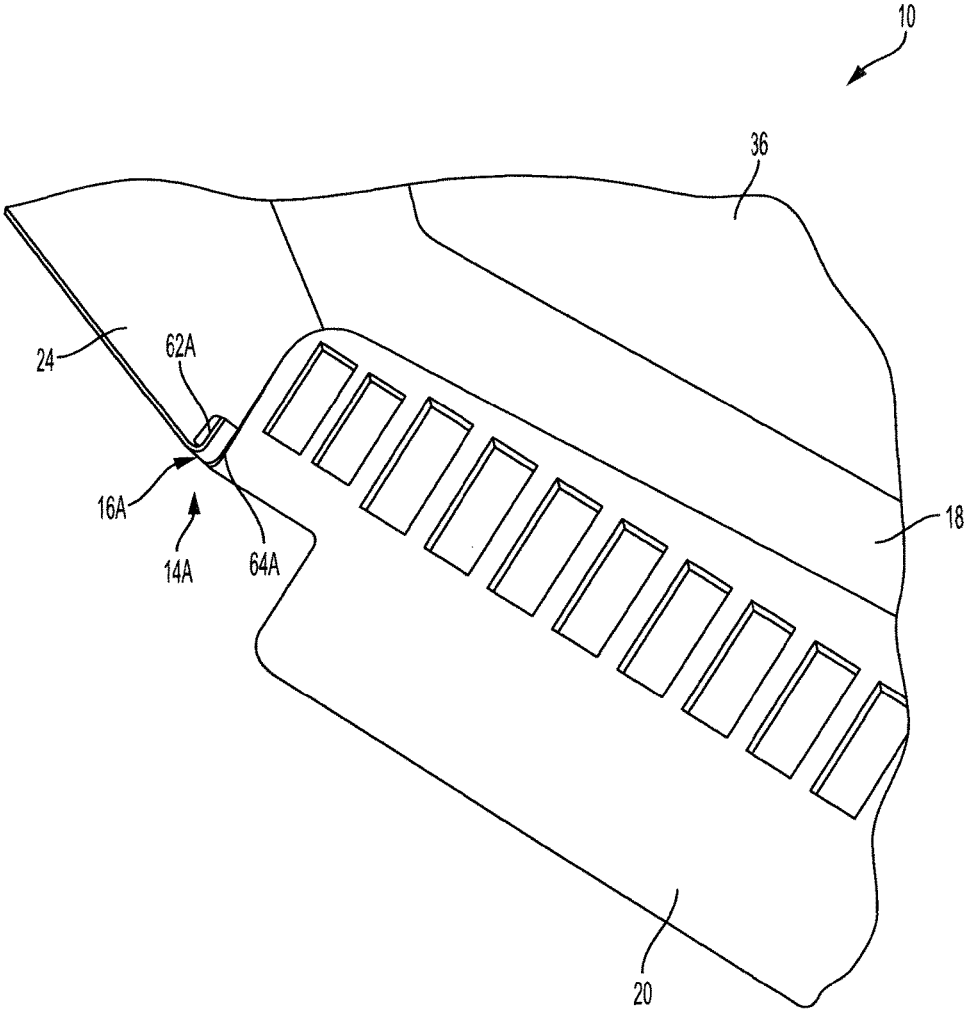
FIG. 5 is an enlarged, fragmented perspective view of the lower left corner of the structure of FIGS. 1 to 4.
Figure 6:
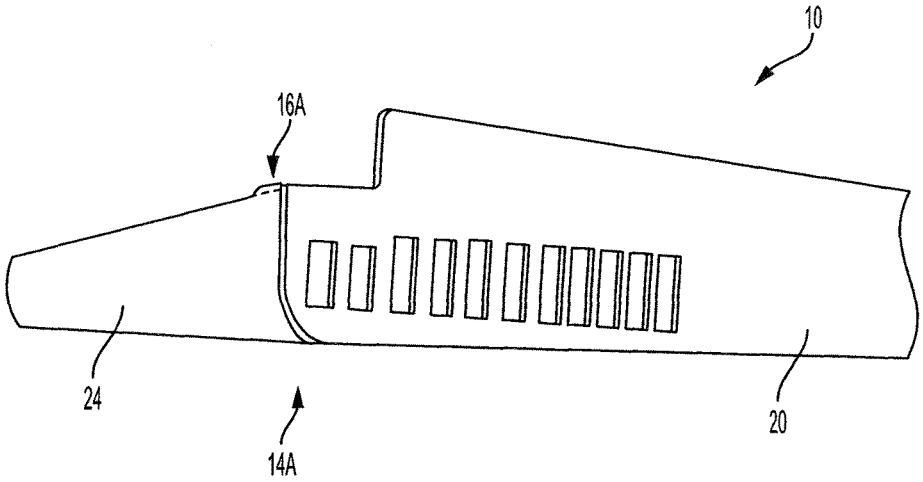
FIG. 6 is another enlarged, fragmented perspective view of the lower left corner of the structure of FIGS. 1 to 5.

It should be understood that the appended drawings are not necessarily to scale, presenting a somewhat simplified representation of various preferred features illustrative of the basic principles of the invention. The specific design features of the one-piece sheet-metal structures as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the structures illustrated in the drawings. In general, up or upward generally refers to an upward direction within the plane of the paper in FIG. 1 and down or downward generally refers to a downward direction within the plane of the paper in FIG. 1. In general, front or forward generally refers to a direction into the plane of the paper in FIG. 1 and rear or rearward generally refers to a direction out of the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the one-piece sheet-metal structures and methods disclosed herein. The following detailed discussion of various alternative and preferred embodiments will illustrate the general principles of the invention with regard to an oven door frame. Other embodiments suitable for other applications will be apparent to those skilled in the art given the benefit of this disclosure such as, for example, other kitchen appliances including dishwashers, refrigerators, and the like.

Referring now to the drawings, FIGS. 1 to 8 and 13 show a one-piece sheet-metal structure 10 in the form of an oven door frame for an oven door 11 according to the present invention. The illustrated oven door frame 10 is formed from a single planar panel or sheet 12 of sheet metal such as, for example, stainless steel or the like. It is noted, however, that other suitable metals can alternatively be utilized such as, for example, CRS. The sheet 12 of sheet metal typically has a thickness in the range of about 0.022 inches to about 0.042 inches. The illustrated oven door frame 10 is rectangular shaped having four corners 14A, 14B, 14C, 14D each with a clinch lock 16A, 16B 16C, 16D so that the corners 14A, 14*b*, 14C, 14D can be weld-free. Thus, no processing is required on the oven door frame 10 once the oven door frame 10 is removed from the stamping dies after the oven frame 10 is formed by stamping with the dies.

The illustrated oven door frame 10 includes a first or main wall 18, a second or bottom wall 20 perpendicularly extending from the first wall 18 in a rearward direction at a second wall bend 22, a third or left wall 24 perpendicularly extending from the first wall 18 in a rearward direction at a third wall bend 26, a fourth or right wall 28 perpendicularly extending from the first wall 18 in a rearward direction at a fourth wall bend 30 opposite the third wall 24, and a fifth or top wall 32 perpendicularly extending from the first wall 18 in a rearward direction at a fifth wall bend 34 opposite the second wall 20. It is noted that the oven door frame 10 can alternatively have any other suitable configuration.

The illustrated first or main wall 18 is generally planar having a forward-facing front planar surface and a rearward-facing rear planar surface. The illustrated first or main wall 18 is rectangular shaped with the second or bottom wall 20 bent at a bottom of the first wall 18, the third or left wall 24 bent at the left side of the first or main wall 18, the fourth or right wall 28 bent at the right side of the first or main wall 18, and the fifth or top wall 32 bent at the top of the first or main wall 18. The illustrated first or main wall 18 also includes a centrally located opening or aperture 36 to form a frame-like configuration. The illustrated opening 36 is generally opening is rectangular shaped but any other suitable opening can alternatively be utilized. It is noted that the opening 36 can be eliminated if desired and/or any other suitable openings can be provided if desired. It is also noted that the first or main wall c18 an alternatively have any other suitable configuration.

The illustrated second or bottom wall 20 is perpendicular to the first wall 18, the third wall 24, and the fourth wall 28, and is parallel to the fifth wall 32. The illustrated second or bottom wall 20 is generally planar having an upward-facing inner or top planar surface and a downward-facing outer or bottom planar surface. The illustrated second or bottom wall 20 is rectangular shaped having a rearward-facing free or rear edge 38 opposite the second wall bend 22, a leftward-facing first or left end edge 40, and a rightward-facing second or right end edge 42. The first end edge 40 of the second wall 20 is adjacent to a first end edge 46 of the third wall 24 to form the first corner 14A. The second end edge 42 of the second wall 20 is adjacent to a first end edge 52 of the fourth wall 28 to form the second corner 14B. It is also noted that the second or bottom wall 20 can alternatively have any other suitable configuration.

The illustrated third or left wall 24 is perpendicular to the first wall 18, the second wall 20, and the fifth wall 32, and is parallel to the fourth wall 28. The illustrated third or left wall 24 is generally planar having a leftward-facing left or outer planar surface and a rightward-facing inner or right planar surface. The illustrated third or left wall 24 is rectangular shaped having a rearward-facing free rear edge 44 opposite the third wall bend 26, a downward-facing first or bottom end edge 46, and an upward-facing second or top end edge 48. The first end edge 46 of the third wall 24 is adjacent to the first end edge 40 of the second wall 20 to form the first corner 14A. A second end edge 48 of the third wall 24 is adjacent to a first end edge 58 of the fifth wall 32 to form the third corner 14C. It is also noted that the third or left wall 24 can alternatively have any other suitable configuration.

The illustrated fourth or right wall 28 is perpendicular to the first wall 18, the second wall 20, and the fifth wall 32, and is parallel with the third wall 24. The illustrated fourth or right wall 28 is generally planar having a leftward-facing left or inner planar surface and a rightward-facing outer or right planar surface. The illustrated fourth or right wall 28 is rectangular shaped having a rearward-facing free rear edge 50 opposite the fourth wall bend 30, a downward-facing first or bottom end edge 52, and an upward-facing second or top end edge 54. The first end edge 52 of the fourth wall 28 is adjacent to the second end edge 42 of the second wall 20 to form the second corner 14B. The second end edge 54 of the fourth wall 28 is adjacent to a second end edge 60 of the fifth wall 32 to form the fourth corner 14D. It is also noted that the fourth or right wall 28 can alternatively have any other suitable configuration.

The illustrated fifth or top wall 32 is perpendicular to the first wall 18, the third wall 24, and the fourth wall 28, and is parallel with the second wall 20. The illustrated fifth or top wall 32 is generally planar having an upward-facing outer or top planar surface and a downward-facing inner or bottom planar surface. The illustrated fifth or top wall 32 is rectangular shaped having a rearward-facing free rear edge 56 opposite the fifth wall bend 34, a leftward-facing first or left end edge 58, and a rightward-facing second or right end edge 60. The first end edge 58 of the fifth wall 32 is adjacent to the second end edge 48 of the third wall 24 to form the third corner 14C. The second end edge 60 of the fifth wall 32 is adjacent to the second end edge 54 of the fourth wall 28 to form the fourth corner 14D. It is also noted that the fourth or top wall 32 can alternatively have any other suitable configuration.

Figure 7:
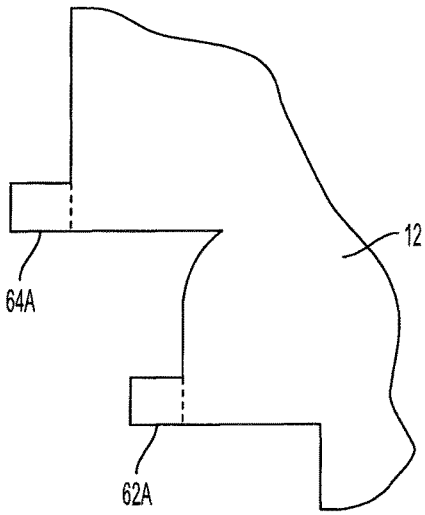
FIG. 7 is diagrammatic view of a portion of a flat sheet for forming the lower left corner of the structure of FIGS. 1 to 6.
Figure 8:
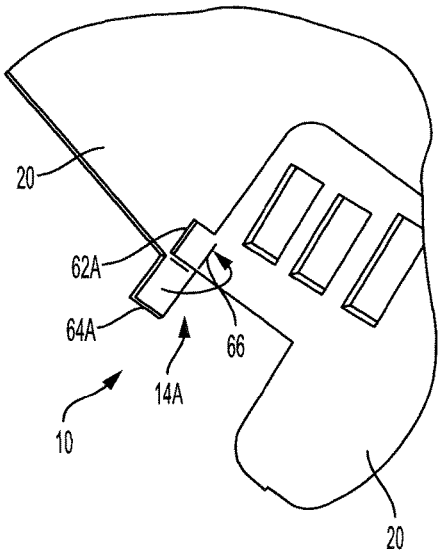
FIG. 8 is diagrammatic view of the flat sheet of FIG. 7 partially bent to form the lower left corner of the structure of FIGS. 1 to 6.

The illustrated first corner 14A is provided with the first clinch lock 16A that includes first bottom and top tabs 62A, 64A. The illustrated first bottom tab 62A inwardly and perpendicularly extends from the first end edge 40 of the second wall 20 at a first bottom tab bend 66, that is the illustrated first bottom tab bend 66 is about 90 degrees, and engages an inner side of the third wall 24. The illustrated first top tab 64A inwardly extends from the outer edge 44 of the third wall 24 at a first top tab bend 68 and is bent around the first bottom tab 62A, that is the illustrated first top tab bend 68 is about 180 degrees, and engages an inner side of the first bottom tab 62A to clench the first bottom tab 62A at the first corner 14A. The illustrated first bottom tab bend 66 is perpendicular to the first top tab bend 68. Note however, that the first bottom tab 62A and the first top tab 64A are substantially parallel in a flat pattern without any bends being formed yet (as best seen in FIG. 7). The illustrated first bottom tab 62A and the illustrated first top tab MA are each rectangular shaped but any other suitable shape can be alternatively utilized. Configured in this manner, the first clinch lock 16A securely holds the first end edge 40 of the second wall 20 and the first end edge 46 of the third wall 24 firmly and securely together so that the first corner 14A can be weld free. It is also noted that the first clinch lock 16A is not visible from the outer sides of the first, second, and third walls 18, 20, 24.

The illustrated second corner 14B is provided with the second clinch lock 16B that includes second bottom and top tabs 62B, 64B that is substantially the same as the first clinch lock 14A described above. The illustrated second bottom tab 62B inwardly and perpendicularly extends from the second end edge 42 of the second wall 20 at a second bottom tab bend 70, that is the illustrated second bottom tab bend 70 is about 90 degrees, and engages an inner side of the fourth wall 28. The illustrated second top tab 64B inwardly extends from the outer edge 50 of the fourth wall 28 at a second top tab bend 72 and is bent around the second bottom tab 62B, that is the illustrated second top tab bend 72 is about 180 degrees, and engages an inner side of the second bottom tab 62B to clench the second bottom tab 62B at the second corner 14B. The illustrated second bottom tab bend 62B is perpendicular to the second top tab bend 64B. The illustrated second bottom tab 62B and the illustrated second top tab 64B are each rectangular shaped but any other suitable shape can be alternatively utilized. Configured in this manner, the second clinch lock 16B securely holds the second end edge 42 of the second wall 20 and the first end edge 52 of the fourth wall 28 firmly and securely together so that the second corner 14B can be weld free. It is also noted that the second clinch lock 16B is not visible from the outer sides of the first, second, and fourth walls 18, 20, 28.

The illustrated third corner 14C is provided with the third clinch lock 16C that includes third bottom and top tabs 62C, 64C that is substantially the same as the first clinch lock 16A described above. The illustrated third bottom tab 62C inwardly and perpendicularly extends from the first end edge 58 of the fifth wall 32 at a third bottom tab bend 74, that is the illustrated third bottom tab bend 74 is about 90 degrees, and engages an inner side of the third wall 24. The illustrated third top tab 64C inwardly extends from an outer edge 44 of the third wall 24 at a third top tab bend 76 and is bent around the third bottom tab 62C, that is the illustrated third top tab bend 76 is about 180 degrees, and engages an inner side of the third bottom tab 62C to clench the third bottom tab 62C at the third corner 14C. The illustrated third bottom tab bend 74 is perpendicular to the third top tab bend 76. The illustrated third bottom tab 62C and the illustrated third top tab 64C are each rectangular shaped but any other suitable shape can be alternatively utilized. Configured in this manner, the third clinch lock 16C securely holds the first end edge 58 of the fifth wall 32 and the second end edge 48 of the third wall 24 firmly and securely together so that the third corner 14C can be weld free. It is also noted that the third clinch lock 16C is not visible from the outer sides of the first, third, and fifth walls 18, 24, 32.

The illustrated fourth corner 14D is provided with the fourth clinch lock 14D that includes fourth bottom and top tabs 62D, 64D that is substantially the same as the first clinch lock 16A described above. The fourth bottom tab 62D inwardly and perpendicularly extends from the second end edge 60 of the fifth wall 23 at a fourth bottom tab bend 78, that is the illustrated third bottom tab bend 78 is about 90 degrees, and engages an inner side of the fourth wall 28. The fourth top tab 64D inwardly extends from the outer edge 50 of the fourth wall 28 at a fourth top tab bend 80 and is bent around the fourth bottom tab 62D, that is the illustrated fourth top tab bend 80 is about 180 degrees, and engages an inner side of the fourth bottom tab 62D to clench the fourth bottom tab 62D at the fourth corner 14D. The illustrated fourth bottom tab bend 78 is perpendicular to the fourth top tab bend 80. The illustrated forth bottom tab 62D and the illustrated fourth top tab 64D are each rectangular shaped but any other suitable shapes can be alternatively utilized. Configured in this manner, the fourth clinch lock 16D securely holds the second end edge 60 of the fifth wall 32 and the second end edge 54 of the fourth wall 28 firmly and securely together so that the fourth corner 14D can be weld free. It is also noted that the fourth clinch lock 16D is not visible from the outer sides of the first, fourth, and fifth walls 18, 28, 32.

Figure 9:
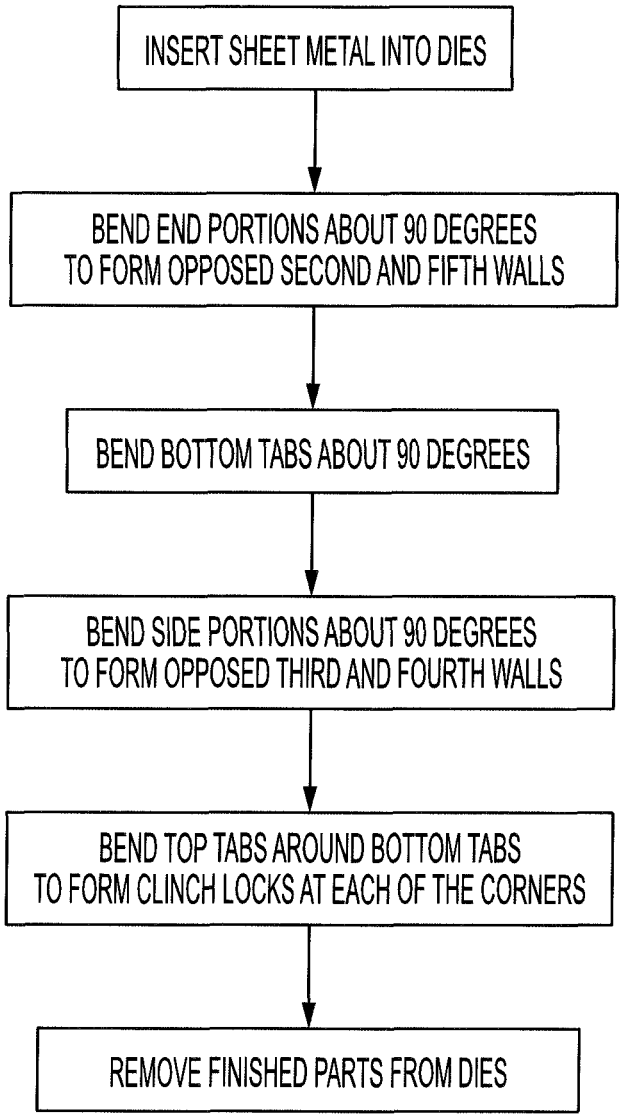
FIG. 9 is a block diagram illustrating a method for forming the structure of FIGS. 1 to 5.

The Illustrated one-piece oven door frame 10 is produced by a stamping process that enables the part to be removed from the die and shipped without any post-stamping processing to finish the part. As illustrated in FIG. 9, stainless-steel sheet metal 12 is placed into the dies and the end portions of the sheet metal 12 are each rearwardly bent about 90 degrees to form the second and fifth walls 20, 32. The first bottom tab 62A is inwardly bent about 90 degrees from the first end edge 40 of the second wall 20. The second bottom tab 62B is inwardly bent about 90 degrees from the second end edge 42 of the second wall 20. The third bottom tab 62C is inwardly bent about 90 degrees from the first end edge 58 of the fifth wall 32. The fourth bottom tab 62D is inwardly bent about 90 degrees from the second end edge 60 of the fifth wall 32. The side portions of the sheet metal 12 are then each rearwardly bent about 90 degrees to form the third and fourth walls 24, 28. The first top tab 64A is inwardly bent around and over the first bottom tab 62B about 180 degrees from the outer edge 44 of the third wall 24 and into engagement with the inner side of the first bottom tab 62A to form the first clinch lock 16A at the first corner 14A (best seen in FIG. 8). The second top tab 64B is inwardly bent around and over the second bottom tab 62B about 180 degrees from the outer edge 50 of the fourth wall 28 and into engagement with the inner side of the second bottom tab 62B to form the second clinch lock 16B at the second corner 14B. The third top tab 64C is inwardly bent around and over the third bottom tab 62B about 180 degrees from the outer edge 44 of the third wall 24 and into engagement with the inner side of the third bottom tab 62C to form the third clinch lock 16C at the third corner 14C. The fourth top tab MD is inwardly bent around and over the fourth bottom tab 64D about 180 degrees from the outer edge 50 of the fourth wall 28 and into engagement with the inner side of the fourth bottom tab 62D to form the fourth clinch lock 16D at the fourth corner 14D. The finished part 10 can then be removed from the dies for shipment and/or use.

Figure 10:
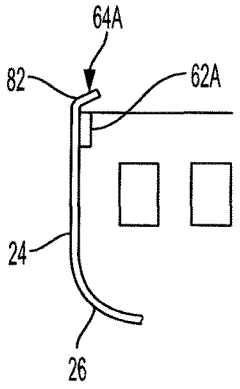
FIG. 10 is diagrammatic view of a first stage of forming the clinch lock corner the structure of FIGS. 1 to 5.
Figure 11:
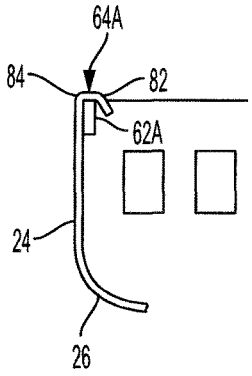
FIG. 11 is diagrammatic view of a second stage of forming the clinch lock corner the structure of FIGS. 1 to 5.
Figure 12:
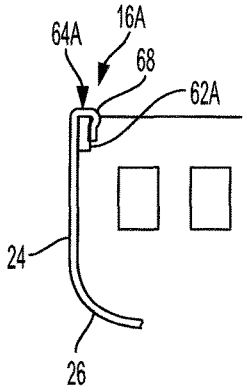
FIG. 12 is diagrammatic view of a third stage of forming the clinch lock corner the structure of FIGS. 1 to 5.
Figure 13:
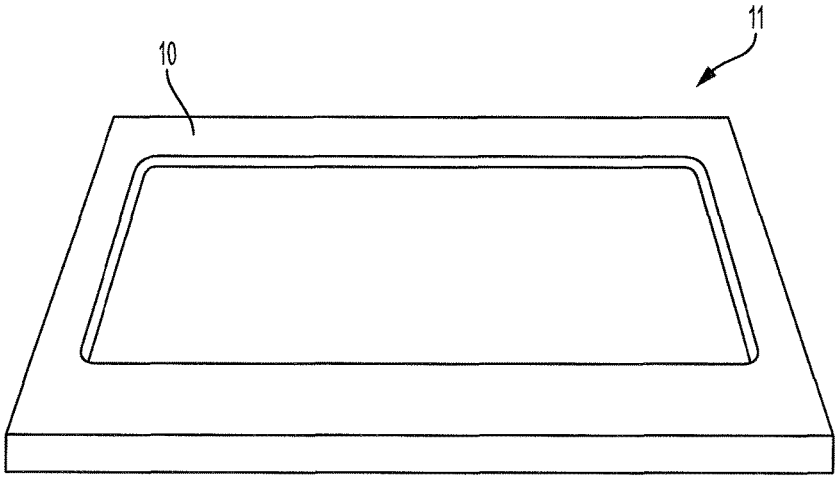
FIG. 13 is perspective view of an oven door including the structure of FIGS. 1 to 5.

As best shown in FIGS. 10 to 12, the illustrated upper tabs 64A, 64B, 64C, 64D are bent to form the clinch locks 16A, 16B, 16C, 16D in a three strike process. In a first form hit, an intermediate bend 82 is formed in the upper tab 64A. In the illustrated embodiment the intermediate bend 82 is about 45 degrees and is located a distance from the outer edge 44 of the wall 24 sized to extend over the rearward edge of the bottom tab 62A. In a second form hit, an end bend 84 is formed in the upper tab 64A. In the illustrated embodiment the end bend 84 is about 90 degrees and is located at the outer edge 44 of the wall 24 so that the upper tab 64A engages and covers the rearward edge of the bottom tab 62A. In a third hit which is preferably a cam hit, the intermediate bend 82 is further bent so that the upper tab 64A is bent around the bottom tab 62A at least 180 degrees and the top tab is engaging the inner side of the bottom tab 62A to form the clinch lock 16A.

Any of the features or attributes of the above the above described embodiments and variations can be used in combination with any of the other features and attributes of the above described embodiments and variations as desired.

It is apparent from the above detailed description of preferred embodiments of the present invention, that the above-disclosed formed part, and the method for forming the part, enable finished parts to be removed and thus eliminate all prior art finishing operations that are required after removal of the part from the dies. The elimination of these finishing operations provides the advantages of: (1) reduced labor and operations; reduced perishables (weld wire, gas, abrasives, etc.) otherwise required to finish the parts; (2) improved surface finish because there cannot be any brush distortion or mismatch because no final surface finishing is required; (3) improved environmental impact because there is no welding or metal finishing byproducts; and (4) major cost reduction due to reduced labor.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. An oven door comprising, in combination:

a stamped one-piece sheet metal oven door frame including:

a first wall;

a second wall perpendicularly extending from the first wall at a second wall bend;

a third wall perpendicularly extending from the first wall at a third wall bend;

wherein the second wall is perpendicular to the third wall;

wherein a first end edge of the second wall is adjacent to a first end edge of the third wall to form a first corner;

a rectangular-shaped first bottom tab perpendicularly extending from the first end edge of the second wall at a first bottom tab bend with a free end of the rectangular-shaped first bottom tab opposite the first bottom tab bend and engaging an inner side of the third wall; and a rectangular-shaped first top tab perpendicularly extending from an outer edge of the third wall at a first top tab bend with a free end of the rectangular-shaped first top tab opposite the first top tab bend and bent around the rectangular-shaped first bottom tab and engaging an inner side of the rectangular-shaped first bottom tab to clench the rectangular-shaped first bottom tab against the inner side of the third wall at the first corner; and wherein the rectangular-shaped first top tab is located at the first end edge of the third wall.

2. The oven door according to claim 1, wherein the sheet metal comprises stainless steel.

3. The oven door according to claim 1, wherein the first bottom tab bend is perpendicular to the first top tab bend.

4. The oven door according to claim 1, wherein the first corner is weld-free.

5. The oven door according to claim 1, wherein the first wall is rectangular shaped.

6. The oven door according to claim 5, wherein the stamped one-piece sheet metal oven door frame further includes:

a fourth wall perpendicularly extending from the first wall at a fourth wall bend;

wherein the fourth wall is parallel with the third wall and on opposed sides of the first wall;

wherein a first end edge of the fourth wall is adjacent to a second end edge of the second wall to form a second corner;

a fifth wall perpendicularly extending from the first wall at a fifth wall bend;

wherein the fifth wall is parallel with the second wall and on opposed ends of the first wall;

wherein a first end edge of the fifth wall is adjacent to a second end edge of the third wall to form a third corner; and wherein a second end edge of the fifth wall is adjacent to a second end edge of the fourth wall to form a fourth corner.

7. The oven door according to claim 6, wherein the stamped one-piece sheet metal oven door frame further includes:

a rectangular-shaped second bottom tab perpendicularly extending from the second end edge of the second wall at a second bottom tab bend with a free end of the rectangular-shaped second bottom tab opposite the second bottom tab bend and engaging an inner side of the fourth wall;

a rectangular-shaped second top tab perpendicularly extending from an outer edge of the fourth wall at a second top tab bend with a free end of the rectangular-shaped second top tab opposite the second top tab bend and bent around the rectangular-shaped second bottom tab and engaging an inner side of the rectangular-shaped second bottom tab to clench the rectangular-shaped second bottom tab against the inner side of the fourth wall at the second corner;

a rectangular-shaped third bottom tab perpendicularly extending from the first end edge of the fifth wall at a third bottom tab bend with a free end of the rectangular-shaped third bottom tab opposite the third bottom tab bend and engaging an inner side of the third wall;

a rectangular-shaped third top tab perpendicularly extending from an outer edge of the third wall at a third top tab bend with a free end of the rectangular-shaped third top tab opposite the third top tab bend and bent around the rectangular-shaped third bottom tab and engaging an inner side of the rectangular-shaped third bottom tab to clench the rectangular-shaped third bottom tab against the inner side of the third wall at the third corner;

a rectangular-shaped fourth bottom tab perpendicularly extending from the second end edge of the fifth wall at a fourth bottom tab bend with a free end of the rectangular-shaped fourth bottom tab opposite the fourth bottom tab bend and engaging an inner side of the fourth wall; and a rectangular-shaped fourth top tab perpendicularly extending from an outer edge of the fourth wall at a fourth top tab bend with a free end of the rectangular-shaped fourth top tab opposite the fourth top tab bend and bent around the rectangular-shaped fourth bottom tab and engaging an inner side of the rectangular-shaped fourth bottom tab to clench the rectangular-shaped fourth bottom tab against the inner side of the fourth wall at the fourth corner; and wherein the rectangular-shaped second top tab is located at the first end edge of the fourth wall, the rectangular-shaped third top tab is located at the second end edge of the third wall, and the rectangular-shaped fourth top tab is located at the second end edge of the fourth wall.

8. The oven door according to claim 7, wherein the first corner, the second corner, the third corner, and the fourth corner are each weld-free.

9. A stamping method for forming a one-piece oven door frame comprising, in combination, the steps of:

providing sheet metal to form a first wall of the one-piece oven door frame;

bending a second wall perpendicularly extending from the first wall at a second wall bend;

bending a third wall perpendicularly extending from the first wall at a third wall bend;

wherein the second wall is perpendicular to the third wall;

wherein a first end edge of the second wall is adjacent to a first end edge of the third wall to form a first corner;

wherein the rectangular-shaped first top tab is located at the first end edge of the third wall;

bending a rectangular-shaped first bottom tab perpendicularly extending from the first end edge of the second wall at a first bottom tab bend with a free end of the rectangular-shaped first bottom tab opposite the first bottom tab bend to engage an inner side of the third wall; and bending a rectangular-shaped first top tab perpendicularly extending from an outer edge of the third wall at a first top tab bend with a free end of the rectangular-shaped first top tab opposite the first top tab bend and around the rectangular-shaped first bottom tab to engage an inner side of the rectangular-shaped first bottom tab to clench the rectangular-shaped first bottom tab against the inner side of the third wall at the first corner.

10. The stamping method according to claim 9, wherein the sheet metal comprises stainless steel.

11. The stamping method according to claim 9, wherein the first bottom tab bend is bent perpendicular to the first top tab bend.

12. The stamping method according to claim 9, wherein the rectangular-shaped first top tab is bent to clench the rectangular-shaped first bottom tab in a three strike process.

13. The stamping method according to claim 9, wherein the corner is weld-free.

14. The stamping method according to claim 9, wherein the first wall is rectangular shaped.

15. The stamping method according to claim 14, further comprising the steps of:

bending a fourth wall perpendicularly extending from the first wall at a fourth wall bend;

wherein the fourth wall is parallel with the third wall and on opposed sides of the first wall;

wherein a first end edge of the fourth wall is adjacent to a second end edge of the second wall to form a second corner;

bending a fifth wall perpendicularly extending from the first wall at a fifth wall bend;

wherein the fifth wall is parallel with the second wall and on opposed ends of the first wall;

wherein a first end edge of the fifth wall is adjacent to a second end edge of the third wall to form a third corner; and wherein a second end edge of the fifth wall is adjacent to a second end edge of the fourth wall to form a fourth corner.

16. The stamping method according to claim 15, further comprising the steps of:

bending a rectangular-shaped second bottom tab perpendicularly extending from the second end edge of the second wall at a second bottom tab bend with a free end of the second bottom tab opposite the rectangular-shaped second bottom tab bend to engage an inner side of the fourth wall;

bending a rectangular-shaped second top tab perpendicularly extending from an outer edge of the fourth wall at a second top tab bend with a free end of the rectangular-shaped second top tab opposite the second top tab bend and around the rectangular-shaped second bottom tab to engage an inner side of the rectangular-shaped second bottom tab to clench the rectangular-shaped second bottom tab against the inner side of the fourth wall at the second corner;

bending a rectangular-shaped third bottom tab perpendicularly extending from the first end edge of the fifth wall at a third bottom tab bend with a free end of the rectangular-shaped third bottom tab opposite the third bottom tab bend to engage an inner side of the third wall;

bending a rectangular-shaped third top tab perpendicularly extending from an outer edge of the third wall at a third top tab bend with a free end of the rectangular-shaped third top tab opposite the third top tab bend and around the rectangular-shaped third bottom tab to engage an inner side of the rectangular-shaped third bottom tab to clench the rectangular-shaped third bottom tab against the inner side of the third wall at the third corner;

bending a rectangular-shaped fourth bottom tab perpendicularly extending from the second end edge of the fifth wall at a fourth bottom tab bend with a free end of the rectangular-shaped fourth bottom tab opposite the fourth bottom tab bend to engage an inner side of the fourth wall; and bending a rectangular-shaped fourth top tab perpendicularly extending from an outer edge of the fourth wall at a fourth top tab bend with a free end of the rectangular-shaped fourth top tab opposite the fourth top tab bend and around the rectangular-shaped fourth bottom tab to engage an inner side of the rectangular-shaped fourth bottom tab to clench the rectangular-shaped fourth bottom tab against inner side of the fourth wall at the fourth corner; and wherein the rectangular-shaped second top tab is located at the first end edge of the fourth wall, the rectangular-shaped third top tab is located at the second end edge of the third wall, and the rectangular-shaped fourth top tab is located at the second end edge of the fourth wall.

17. The stamping method according to claim 16, wherein the first corner, the second corner, the third corner, and the fourth corner are each weld-free.

18. The stamping method according to claim 16, wherein the rectangular-shaped second top tab is bent to clench the rectangular-shaped second bottom tab in a three strike process, the rectangular-shaped third top tab is bent to clench the rectangular-shaped third bottom tab in a three strike process, and the rectangular-shaped fourth top tab is bent to clench the rectangular-shaped fourth bottom tab in a three strike process.

19. A one-piece oven door frame formed by a stamping method comprising, in combination, the steps of:

providing a sheet of stainless steel to form a first wall of the one-piece oven door frame;

bending a second wall perpendicularly extending from the first wall at a second wall bend;

bending a third wall perpendicularly extending from the first wall at a third wall bend;

wherein the second wall is perpendicular to the third wall;

wherein a first end edge of the second wall is adjacent to a first end edge of the third wall to form a first corner;

wherein the rectangular-shaped first top tab is located at the first end edge of the third wall;

bending a rectangular-shaped first bottom tab perpendicularly extending from the first end edge of the second wall at a first bottom tab bend with a free end of the rectangular-shaped first bottom tab opposite the first bottom tab bend to engage an inner side of the third wall; and bending a rectangular-shaped first top tab perpendicularly extending from an outer edge of the third wall at a first top tab bend with a free end of the rectangular-shaped first top tab opposite the first top tab bend and around the rectangular-shaped first bottom tab to engage an inner side of the rectangular-shaped first bottom tab to clench the rectangular-shaped first bottom tab against the inner side of the third wall at the first corner.

20. The stamping method according to claim 19, wherein the rectangular-shaped first top tab is bent to clench the rectangular-shaped first bottom tab in a three strike process.

* * * * *